US007422351B2

(12) United States Patent
Villani

(10) Patent No.: US 7,422,351 B2
(45) Date of Patent: Sep. 9, 2008

(54) POLE LIGHT ELECTRICAL INTERFACE

(76) Inventor: Alexander R. Villani, 10451 Mahogany Ct., Alta Loma, CA (US) 91737

( * ) Notice: Subject to any disclaimer, the term of this patent is extended or adjusted under 35 U.S.C. 154(b) by 113 days.

(21) Appl. No.: 11/443,610

(22) Filed: May 30, 2006

(65) Prior Publication Data

US 2007/0279922 A1 Dec. 6, 2007

(51) Int. Cl.
*B60Q 1/00* (2006.01)

(52) U.S. Cl. ..... 362/477; 362/540; 362/652; 362/431; 114/343

(58) Field of Classification Search ..... 362/477, 362/652, 640, 540; 114/66, 610, 343; 439/668
See application file for complete search history.

(56) References Cited

U.S. PATENT DOCUMENTS 5,142,457 A * 8/1992 Wehner ..... 362/477
5,766,020 A * 6/1998 Hughes ..... 439/35
6,062,713 A * 5/2000 Renlger et al. ..... 362/477
6,848,815 B1 * 2/2005 Born ..... 362/477

OTHER PUBLICATIONS

Calrad Electronics (www.ba-electronics.com/12v-acc.html). Web publication.
iboats.com (www.iboats.com) page of "pole lights" Web Publication.
Nav Rules (www.auxetrain.com) page of lights.

* cited by examiner

*Primary Examiner*—Ali Alavi
(74) *Attorney, Agent, or Firm*—J. Curtis Edmonds

(57) ABSTRACT

A pole light electrical interface is described that allows the connection of electrical devices in lieu of standard pole lights that are used as running lights on boats. Several configurations are described including a connection in place of a running light, a side connector, and a pole light electrical interface with a voltage converter.

9 Claims, 6 Drawing Sheets

POLE LIGHT ELECTRICAL INTERFACE

BACKGROUND

1. Field of the Invention

This invention relates to mechanical electrical interfaces in general and electrical interfaces for boating enthusiasts in particular.

2. Background

The use of lights in boats is an important aspect of operating a watercraft. While the boat is operating on the water conveys the status and position of the boat to other watercraft. (See "A Short Course in Nav Rules", http://www.auxetrain-.org/navhelp.html). These lights are commonly known as "running lights".

One type of running light is a "pole light". A pole light consists of a rod with the light located on one end of the pole. The pole light is then mounted and extends upwards away from the hull.

One type of pole light is a detachable from the hull of the boat. A permanent base is mounted to the hull of the boat and the pole and light configuration is inserted into the permanent base. This type of pole light ("detachable pole light") allows for easier maintenance and the ability to different types of colored lights to be exchanged. FIG. 1 is representative of this prior art. Detachable pole lights are well know in the arts and widely available (See www.iboats.com).

Battery powered electronic devices are now commonplace. Laptop computers, radios, and even battery powered tools are widely marketed and known in the arts. Many of these devices have the ability to be powered by an external DC power source. For example, the Zire 31 handheld sold by Palm, Inc. includes an AC to DC adapter so that the device may be recharged when the battery has been depleted (see http://www.palm.com/us/support/handbooks/zire31/Zire31 UG ENG.pdf)). This is just one example of thousands of products that have internal battery packs that require recharging.

Boats, by their very nature, are limited in their ability to connect to a land based AC power grid. Therefore these power adapters have limited use when the boat are operating in the open water. Only in boats where AC outlets are accessible can these devices be connected to either operate or keep the internal batteries of the device charged.

Alternating current inverters, which convert DC to AC are well known in the arts. Inverters can be installed in the boat and subsequently wires installed to other locations, including areas near the running lights. Unfortunately, the cost of installing wiring in a boat can be significant. It involves hiring skilled technicians who are familiar with the boat modifications. Any modifications made to the boat hull or deck are of particular significance due to impact on the design of the boat.

SUMMARY OF THE INVENTION

A pole light electrical interface is described where the pole light electrical interface comprises a bottom electrical adapter that interfaces to a pole light plug. Internal wires are connected to a female socket that accepts a cigarette lighter adapter.

Other embodiments of the invention allow for various types of other connectors. Other embodiments of the invention provide for configurations of the connectors and multiple locations of the connections. Other voltage outputs are also incorporated into the device via DC to DC converters and DC to AC inverters.

BRIEF DESCRIPTION OF THE DRAWINGS

Taking the following specifications in conjunction with the accompanying drawings will cause the invention to be better understood regarding these and other features and advantages. The specifications reference the annexed drawings wherein.

DETAILED DESCRIPTION

The following description of the presently contemplated best mode of practicing the invention is not to be taken in a limiting sense, but is made merely for the purpose of describing the general principles of the invention. The scope of the invention should be determined with reference to the claims.

Figure 1:
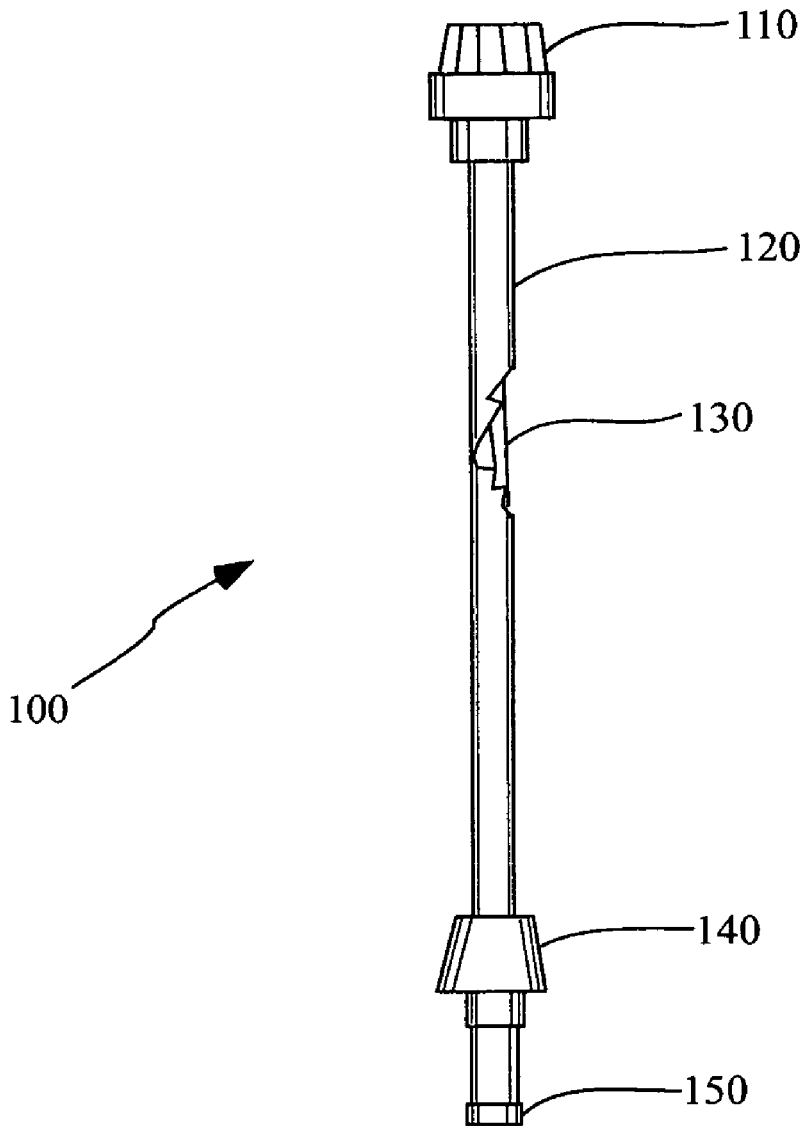
Fig. 1 (Prior Art)
FIG. 1 is a prior art view of the detachable pole light.

Now referring to FIG. 1, a side view of a pole lamp. These pole lamps are widely used in the boating community and well known in the arts. A pole lamp 100 consists of a lighting fixture 110, a pole 120 connected to the lighting fixture 110, a threaded collar 140 that encircles the pole 120. An electrical plug 150 is mounted at the base of the pole 120. A pair of wires 130 runs from the electrical plug 150 to the light 110.

The operation of the pole lamp 100 consists of inserting electrical plug 150 into a base (not shown) that mates with the electrical plug 150. The threaded collar 140 is pulled down and screwed onto the base forming a seal preventing the intrusion of water into the electrical connection. When current runs through the pair of wires 130, the lighting fixture 110 is illuminated.

Figure 2A:
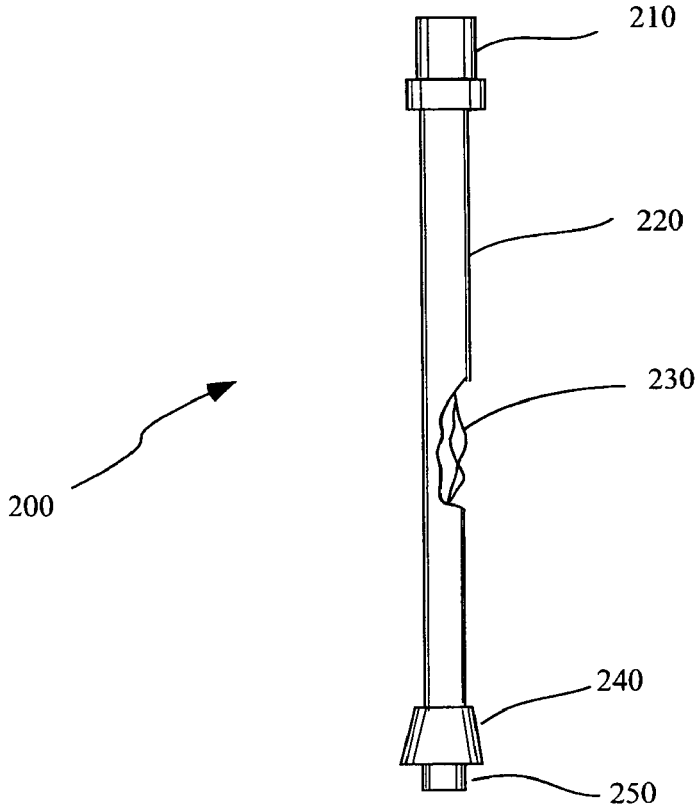
FIG. 2A is a side view of the pole light electrical interface.
Figure 2B:
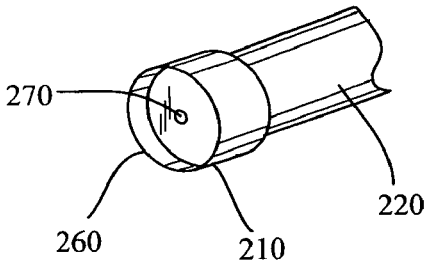
FIG. 2B is a top view of the pole light electrical interface.
Figure 2C:
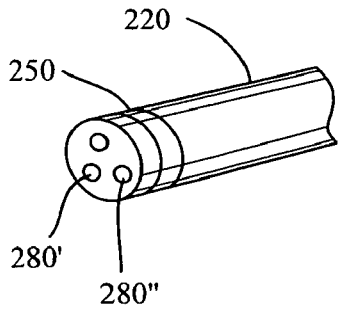
FIG. 2C is a bottom view of the pole light electrical interface.

Now referring to FIGS. 2A, 2B, and 2C, are different views of the preferred embodiment of the electrical pole interface. FIG. 2A is a side view of the electrical pole interface. FIG. 2B is a top view of the electrical pole interface. FIG. 2C is a bottom view of the electrical pole interface.

In FIG. 2A, an electrical pole interface 200 is shown with an electrical adapter 210 attached to a pole 220 that is attached to an electrical connector 250 at the base. A threaded collar 240 encircles the pole 220 that is used for mating to a based located on the boat (not shown). A cutaway portion of the pole shows wiring from the base electrical connector 250 to the electrical adapter 210.

In FIG. 2B, a top view of the electrical pole interface 200 depicts an electrical adapter 210. The electrical adapter 250 is a female adapter with an electrical connection on the inside wall 260 of the electrical adapter 250. The preferred embodiment of the electrical adapter 250 is configured to be the approximate dimensions of a commonly available 12 VDC cigarette lighter adapter.

In FIG. 2C, a bottom view of the electrical pole interface 200 depicts an electrical connector 250. The electrical connector 250 has two female electrical interfaces 280', 280". During boat operation, the electrical connector 250 is inserted into a male adapter located on the boat hull (not shown).

As in FIG. 2B, the preferred embodiment of the electrical pole interface 200 uses an electrical adapter 250 with the configurations that are approximately the same dimensions as a cigarette lighter electrical adapter. These adapters are commonplace and available at a number of commercial outlets (See http://www.ba-electronics.com/12v-acc.htm for a sample list of adapters).

Figure 3:
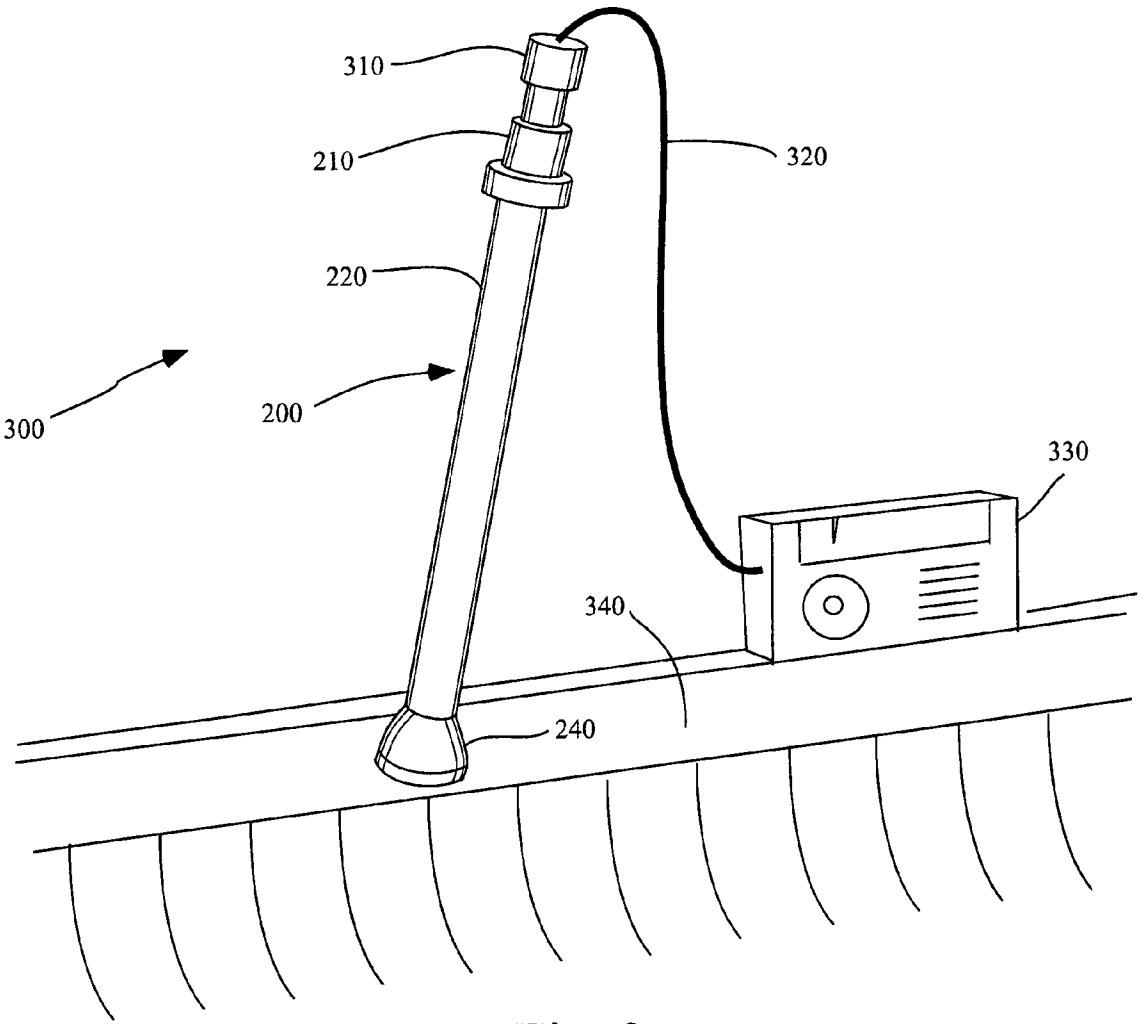
FIG. 3 is a side view of the pole light electrical interface with a car cigarette lighter inserted.

Now referring to FIG. 3. As shown in FIG. 3., a view 300 of the electrical pole interface 200 as installed in a boat is shown. An electrical pole interface 200 consists of the threaded collar 240 connected to the boat hull 340. The pole 220 is connected to the threaded collar 240 and the electrical adapter 210. A cigarette lighter adapter 310 is inserted into the electrical adapter 210. A wire 320 is connected to the cigarette adapter 310 carrying power to a DC powered device 330. The DC powered device 330 is designed to accommodate the voltage levels of the boat's electrical system that is typically 12 VDC.

Figure 4:
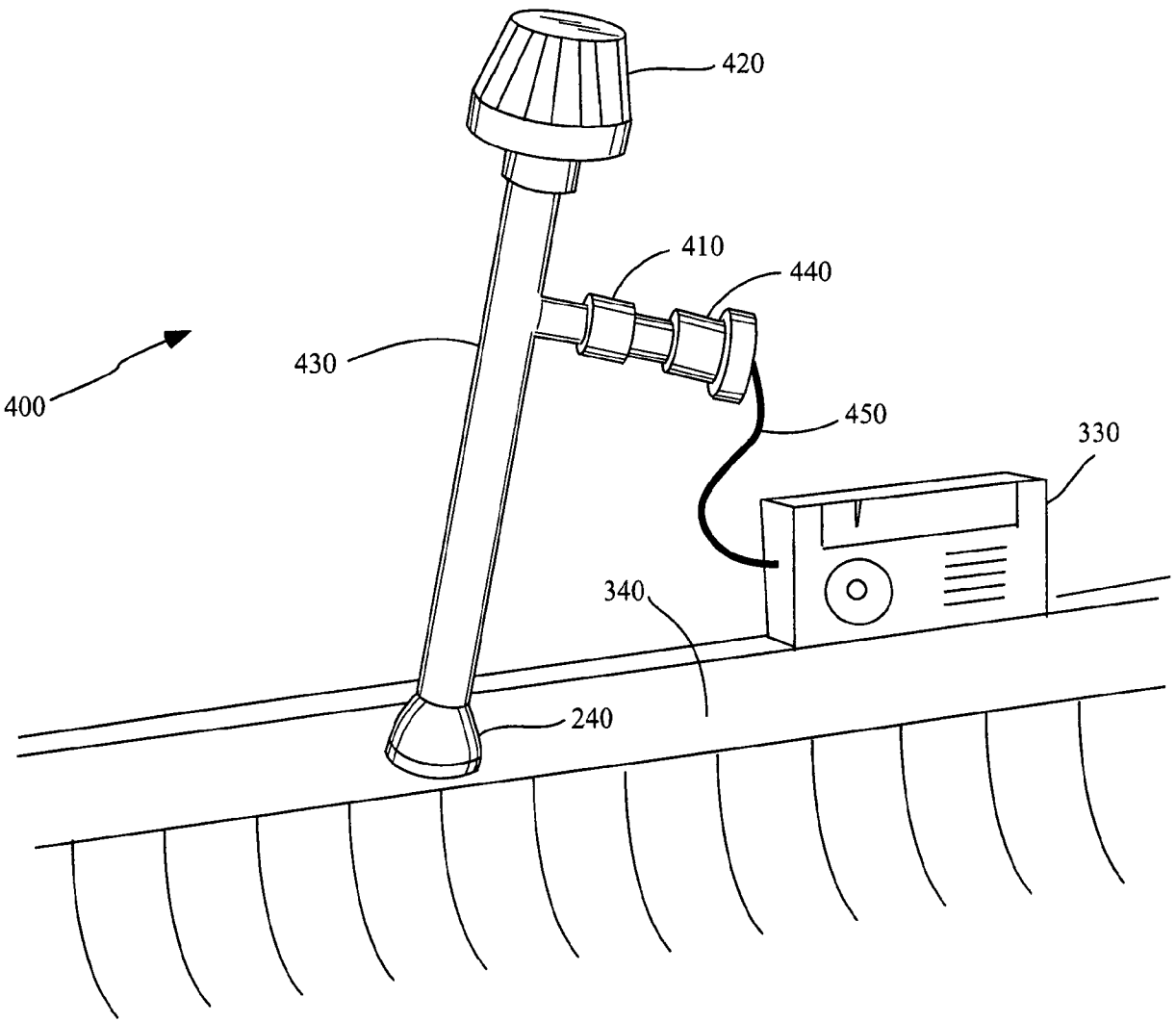
FIG. 4 is a side view of the pole light electrical interface with a car cigarette lighter integrated into the pole.

Now referring to FIG. 4. Another embodiment 400 of the electrical pole interface is shown.

In the embodiment as shown in FIG. 4., the electrical base 240 of a T style electrical pole 430 is connected to the boat hull 340. A running light 420 is connected to the top of the T style electrical pole 430 in a configuration that resembles the prior art as shown in FIG. 1. An electrical adapter 440 is connected to an offshoot plug on the T-style electrical pole 430. As in FIG. 3 the electrical adapter 440 is connected to a wire 450 that is connected to an electrical device 330.

In the embodiment as shown in FIG. 4, the number of connectors on the side of the pole are not limited. Likewise, the connectors may be positioned at any angle to facilitate connections.

Figure 5A:
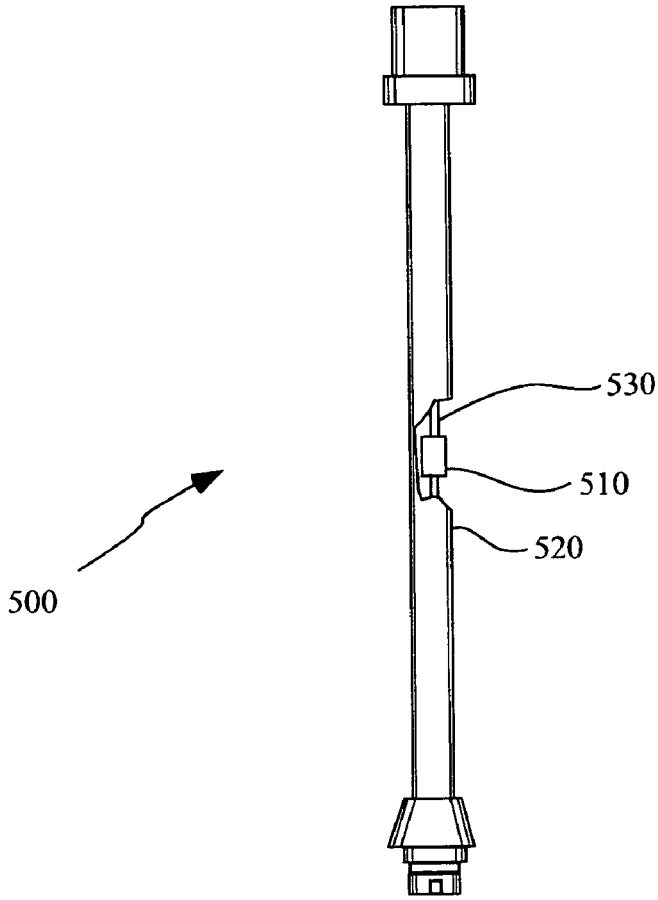
FIG. 5A is a side view of the pole light electrical interface with a DC to DC converter integrated with a multipurpose DC adapter.
Figure 5B:
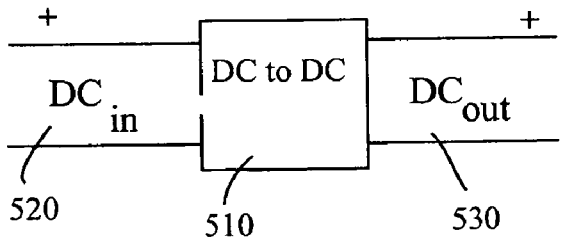
FIG. 5B is a systems diagram of the pole light electrical interface with a DC converter.

Now referring to FIG. 5A and FIG. 5B. An alternate embodiment of the electrical pole interface 500 is shown in FIG. 5A. In this alternate embodiment, the electrical wires that are internal to the pole have been spliced and replaced with a DC to DC converter. This would allow devices that are not adapted to the boat's voltage supply to operate properly.

In this embodiment, the DC to DC converter 510 is positioned with the electrical pole. Input wires 520 to the DC to DC converter 520 are connected to the base of the electrical pole. Output wires 530 run up to the electrical adapter. A schematic of the DC to DC converter is shown in FIG. 5B.

Figure 6A:
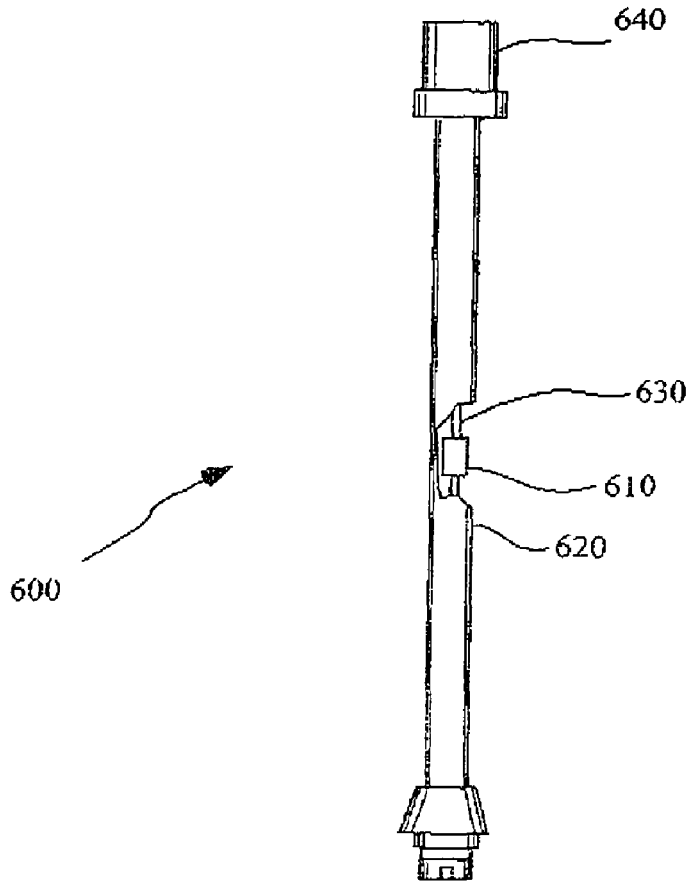
FIG. 6A is a side view of the pole light electrical interface with an AC inverter integrated within the pole light.
Figure 6B:
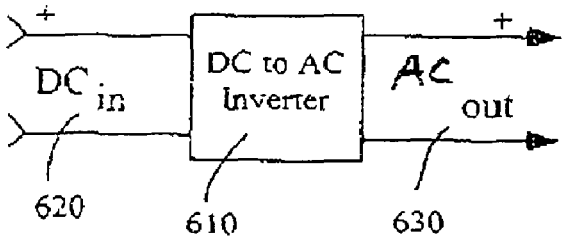
FIG. 6B is a systems diagram of the pole light electrical interface with an AC inverter.
Figure 6C:
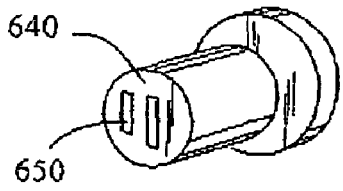
FIG. 6C is a view of a standard 115 VAC plug

Now referring to FIGS. 6A, 6B, and 6C. An alternate embodiment of the electrical pole interface 500 is shown in FIG. 6A. In this alternate embodiment, the electrical wires that are internal to the pole have been spliced and replaced with a DC to AC inverter. This would allow devices that run on 115 VAC to operate properly.

In this embodiment, the DC to AC inverter 610 is positioned with the electrical pole. Input wires 620 to the DC to AC inverter 620 are connected to the base of the electrical pole. Output wires 630 run up to an electrical socket 640 as shown in FIG. 6C. External AC operated devices would connect to the AC plug 650 using a standardized plug connection. A schematic of the DC to AC converter is shown in FIG. 6B The alternate embodiments as shown in FIG. 4 and FIG. 5 can also use the T-style configuration as shown in FIG. 3. Also, it possible for all three of the embodiments, the direct connection, the DC to DC converter, and the AC to DC inverter in to co-exist in one electrical pole.

I claim:

1. A pole light electrical interface, said pole light electrical interface comprising:

a bottom electrical adapter, said bottom electrical adapter configured to interface to a pole light plug; and a pole, said pole comprising power wires internal to said pole and connected to said bottom electrical adapter; and a top electrical adapter, said top electrical adapter configured to accept an electrical plug, wherein the electrical plug is connected to a wire, the wire is further adaptable to connect to a power device, so that when a voltage is connected to the pole light plug, power flows to the power device.

2. The pole light electrical interface as in claim 1 wherein said pole light plug is mounted on a boat hull.

3. The pole light electrical interface as in claim 1 wherein said pole light plug is configured to accept a conventional running light pole.

4. The pole light electrical interface as in claim 1 wherein said top electrical adapter is configured to accept a male cigarette lighter electrical adapter.

5. The pole light electrical interface as in claim 4 wherein said electrical adapter is mounted on the side of the pole.

6. The pole light electrical interface as in claim 1 further comprising an DC to DC converter, said DC to DC converter consisting of an input port and an output port; wherein said DC to DC converter is inserted between the bottom electrical adapter and the top electrical adapter, and wherein the power wires from the bottom adapter are connected to input port and wherein a second set of power wires are connected from the output port to the top electrical adapter.

7. The pole light electrical interface as in claim 1 further comprising an DC to AC inverter, said DC to AC inverter consisting of an input DC port and an output AC port; wherein said AC to DC converter is inserted between the bottom electrical adapter and the top electrical adapter, and wherein the power wires from the bottom adapter are connected to input DC port and wherein a second set of power wires are connected from the output AC port to the top electrical adapter.

8. The pole light electrical interface as in claim 7 wherein said top electrical adapter is configured to a conventional 115 VAC female outlet.

9. The pole light electrical interface as in claim 1 wherein there is a multiplicity of said top electrical adapters.

* * * * *